United States Patent [19]

Owens

[11] 4,396,134

[45] Aug. 2, 1983

[54] POURING ADAPTER-CLOSURE ASSEMBLY

[75] Inventor: Phillip J. Owens, Louisville, Ky.

[73] Assignee: The West Company, Phoenixville, Pa.

[21] Appl. No.: 250,649

[22] Filed: Apr. 3, 1981

[51] Int. Cl.[3] ..... B65D 25/48

[52] U.S. Cl. ..... 222/562; 222/570

[58] Field of Search ..... 222/544, 548, 551, 562, 222/566, 567, 570, 571, 512

[56] References Cited

U.S. PATENT DOCUMENTS

| | | | |
|---|---|---|---|
| 2,751,131 | 6/1956 | Nyden | 222/562 |
| 2,848,145 | 8/1958 | Livingstone | 222/542 |
| 2,917,198 | 12/1959 | Beall | 215/73 |

FOREIGN PATENT DOCUMENTS

| | | | |
|---|---|---|---|
| 514164 | 11/1939 | United Kingdom | 222/571 |

*Primary Examiner*—Joseph J. Rolla
*Assistant Examiner*—Michael S. Huppert
*Attorney, Agent, or Firm*—Eugene E. Renz, Jr.

[57] ABSTRACT

A pouring adaptor to be secured to the discharge end of a container or the like comprising a generally cylindrical skirt portion having a bead at its lower terminal edge for detachably securing it to the container finish and a radially inwardly directed top portion which snugly seats on the axial end face of the container. The top portion has a frusto-conical outer face which is outwardly divergent from its inner peripheral edge and a reversely tapered flexible flange which is downwardly divergent from the juncture of the frusto-conical outer-face and flange.

3 Claims, 5 Drawing Figures

POURING ADAPTER-CLOSURE ASSEMBLY

BACKGROUND OF THE INVENTION

The present invention relates to new and improved no-drip pouring adaptors for use on containers for liquid products. More particularly the invention relates to a new and improved combination pouring adaptor-closure assembly having novel features of construction and arrangement.

Pouring adaptors of the general type to which the present invention relates are not new per se. Various types of pouring adaptors and in some instances pouring adaptor-closure assemblies are shown in the following U.S. Patents:

| Inventor | U.S. Pat. No. | Issue Date |
|---|---|---|
| Miller | 3,339,772 | Sept. 5, 1967 |
| Ayotte et al | 3,318,496 | May 9, 1967 |
| Whitney | 3,179,290 | April 20, 1965 |
| Kitterman | 3,198,393 | Aug. 3, 1965 |
| Sundgren | 3,491,925 | Jan. 27, 1970 |
| Micallef | 3,429,488 | Feb. 25, 1969 |
| Miller | 3,319,842 | May 16, 1967 |
| Unger | 3,297,211 | Jan. 10, 1967 |
| Livingstone | 2,763,402 | Sept. 18, 1956 |
| Kirschenbaum | Re 24,695 | Sept. 8, 1959 |
| Stull | 3,117,701 | Jan. 14, 1964 |
| Gibson | 3,311,275 | March 28, 1967 |
| Miller | 3,323,693 | June 6, 1967 |
| Clare | 3,330,450 | July 11, 1967 |
| Clare | 3,361,307 | Jan. 2, 1968 |
| Cruikshank | 3,563,422 | Feb. 16, 1971 |
| Owens | 3,980,211 | Sept. 14, 1976 |

The Miller U.S. Pat. No. 3,339,772 shows a pouring adaptor which seats in the inside of the neck of the container and has a conical shaped portion terminating in a central discharge opening through which the contents of the container are dispensed. In one form the cap has a pin-like protuberance which engages in the opening in the adaptor to seal the discharge opening and to retain the adaptor and cap as a unit.

The Ayotte et al U.S. Pat. No. 3,318,496 shows a pouring adaptor and closure assembly generally similar to Miller. In this instance, however, the adaptor which also seats in the interior of the neck of a container has a base and an elongated cylindrical pouring spout projecting from the base which has a conical outwardly divergent upper wall and the container likewise has a cylindrical projection which engages in the sleeve-like projection of the adaptor to seal the same.

Whitney U.S. Pat. No. 3,179,290 also shows a pouring adaptor which seats inside the neck of the container and has an outwardly flared pouring lip. Kitterman U.S. Pat. No. 3,198,393; Sundgren U.S. Pat. No. 3,491,925 and Micallef U.S. Pat. No. 3,429,488 show similar type adaptors.

There are also a number of adaptors as exemplified by the Miller U.S. Pat. No. 3,319,842 and Unger U.S. Pat. No. 3,297,211 wherein the adaptor includes a central projection which depends into the neck of the container and wherein the discharge end includes an outwardly flared lip.

Even though these adaptors are generally suitable for the purposes intended, the present invention differs structurally from these adaptors and provides an arrangement which is easy and economical to manufacture and assemble by utilizing automatic capping equipment. Thus, the adaptor of the present invention comprises an annular member adapted to seat and lock on the axial end face and the outer peripheral side of the container finish. The annular member includes a generally cylindrical depending skirt portion which has at its lower terminal edge a radially inwardly directed bead which seats in a groove in the outer surface of the container finish and a radially inwardly directed top which overlies the axial end face of the container and has a no-drip pouring face configuration consisting of radially outwardly divergent face and a reversely tapered conical peripheral flexible flange. This configuration provides the most effective surface configuration to ensure the no-drip characteristic. Furthermore, the reversely tapered flexible flange also provides an important additional function in that it engages in an internal peripherally extending pocket at the juncture of the top and sidewall of the closure cap to retain the adaptor and cap as an integral assembly prior to application to the container. Flexibility of the flange also ensures retention of the adaptor on the container when the cap in normal use is rotated to remove it from the container. In the present instance, the container also has a circumferentially extending sealing flange depending from the top which engages the top pouring face of the adaptor to provide a primary seal with this face. The reversely tapered flexible flange also adds a secondary seal in the manner in which it engages in the cap pocket.

The adaptor and cap are preferably made of a plastic material and can be produced rather economically and quickly on conventional high speed automatic plastic molding equipment. Furthermore, the adaptor and cap are easily assembled as a unit prior to application to a container by automatic handling equipment. The configuration of the adaptor and the pocket in the cap are such that critical alignment to assemble the two is not necessary, the reversely oriented flexible flange providing a degree of flexibility in aligning the parts for assembly as a unit. The adaptor-closure unit is simply applied to a container by threading the cap on the container whereby the rib at the lower edge of the skirt of the adaptor flexes to engage over the finish and seat in the groove in the manner shown. The seating force of the adaptor on the container is greater than that provided by the reversely tapered flexible flange in the pocket of the cap so that now when the cap is removed, the adaptor remains firmly seated on the end of the container.

DESCRIPTION OF THE DRAWING

These and other objects of the present invention and the various features and details of the operation and construction thereof are hereinafter more fully set forth with reference to the accompanying drawings, wherein.

DESCRIPTION OF THE PREFERRED EMBODIMENT

Figure 1:
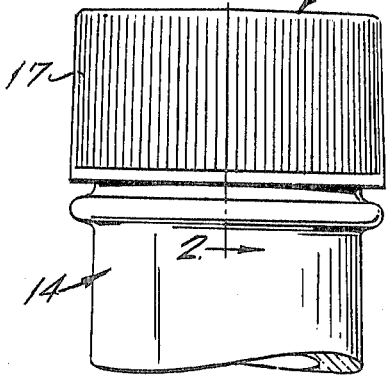
FIG. 1 is a side elevational view of an adaptor-closure assembly applied to a container.
Figure 5:
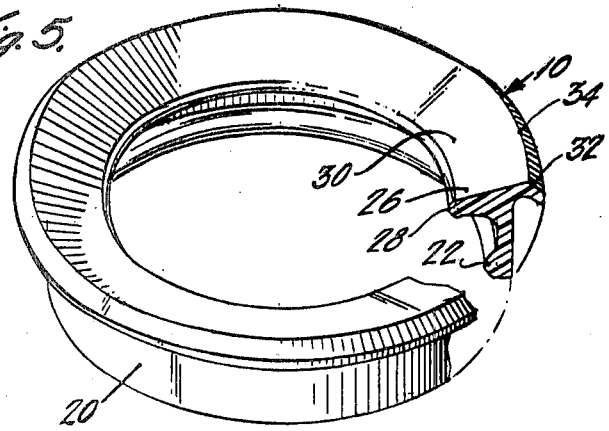
FIG. 5 is a perspective view of the adaptor in accordance with the present invention.
Figure 2:
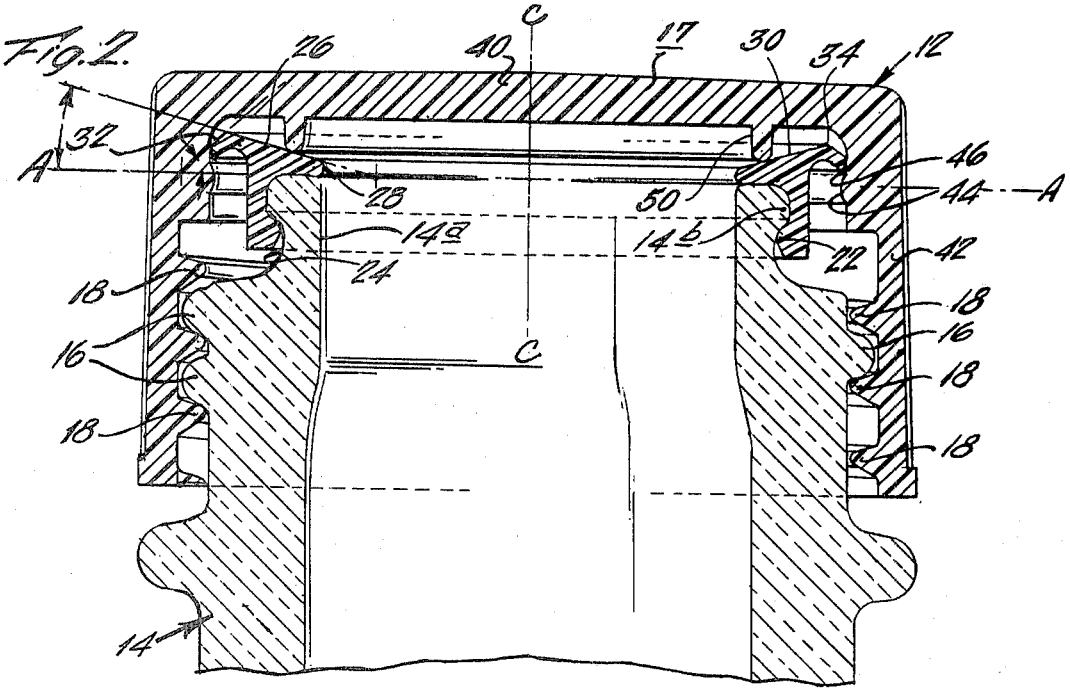
FIG. 2 is an enlarged fragmentary transverse sectional view showing the assembly seated on the container.
Figure 3:
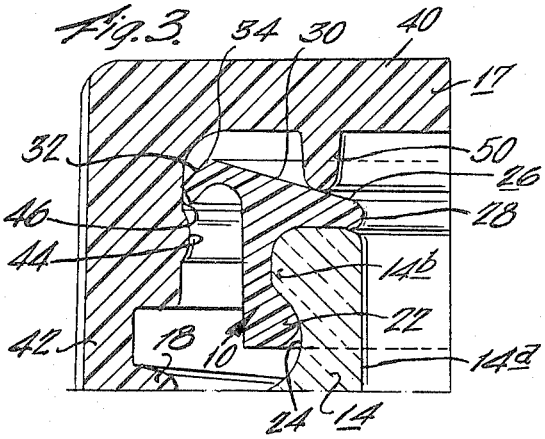
FIG. 3 is an enlarged fragmentary transverse sectional view showing the details of the adaptor and portion of the cap.

Referring now to the drawings and particularly to FIG. 2 thereof there is illustrated a pouring adaptor-closure assembly generally designated by the numerals 10 and 12 applied to a container 14. The container may be of glass and have a finish comprising external threads 16 and the closure cap 12 may also be provided with internal threads 18 for seating and unseating the cap on the container.

The adaptor 10 is preferably made of an easily moldable plastic material, such as, polypropylene and as illustrated comprises a generally cylindrical skirt portion 20 having a radially inwardly directed rib 22 at its lower terminal edge which seats in an annular groove 24 defined in the external wall of the neck of the container and spaced downwardly from the axial end face thereof. The adaptor further includes a radially inwardly directed top portion 26 which snugly seats on the axial end face of the container, the inner terminal circumferential edge 28 of which as illustrated is aligned with the discharge opening 14*a* in the container. The top portion has a frusto-conical outer face 30 which is outwardly divergent from its inner edge and is preferably disposed at an angle of about 15° to a plane A—A transverse to the central axis of the adaptor and in the assembled relation to the axis C of the discharge opening 14*a* of the container. The top portion also includes a reversely tapered flexible flange 32 which as illustrated is downwardly divergent from the juncture 34 of the top face at an angle of preferably 30° to the plane A—A. Note that the juncture 34 of the flexible flange 32 and frusto-conical outer face 30 lies outside the peripheral side wall of the adaptor to provide flexibility permitting seating of the adaptor in the cap and removal of the cap when desired without unseating the adaptor. The radial projection X of the flexible flange 32 may be in the order of 0.039". By this arrangement, when the container is tilted to pour the contents, the contents flow smoothly over the face 30 and flange 32 of the adaptor and then when it is desired to terminate pouring, the juncture 34 serves as an abrupt cutoff minimizing the chance of dripping of any fluids from the flexible flange 32 and in this respect the adaptor may be termed "no drip". Of course, as the container is inverted to an upright position, any fluid on the top face 30 flows directly back into the container.

In the present instance, the closure or cap 17 is a screw-type cap and is made from easily moldable plastic material such as polypropylene or polyethylene. The cap has a generally disc-like top 40, a skirt 42 depending from the top and internal spiral threads 18 to mate with the threads 16 on the container for applying and removing the cap. A radially inwardly projecting rib 44 is provided on the interior wall of the skirt 42 spaced downwardly slightly from the inside of the top panel to define a recess or pocket 46 for the flexible flange 32 of the adaptor for a purpose to be described in more detail below. The top also has a circumferentially extending depending sealing flange or rib 50 which engages the tapered face 30 of the adaptor to provide a first seal when the cap is fully seated on the container in the manner shown in FIG. 2.

Figure 4:
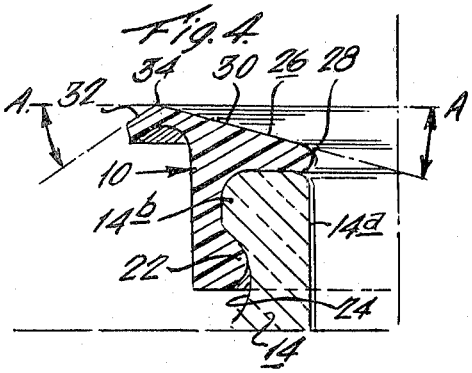
FIG. 4 is a view similar to FIG. 3 with the cap removed.

Considering now the manner in which the parts cooperate to provide a pouring adaptor-closure assembly which is easy and economical to manufacture and assemble to form an integral unit prior to application to a container, the adaptor 10 and cap 12 are, of course, made separately by conventional molding techniques. Thereafter, the adaptor 10 may be assembled to the cap 12 by automatic orientation and assembly equipment which, for example, orients the adaptor so that the top portion faces up and then is automatically inserted in the inside of the cap until the flexible reversely tapered flange engages the rib 44 and flexes inwardly until it passes the rib and engages in the pocket 46 and in this manner is retained in the cap and forms therewith an integral assembly which is now ready to be applied to a screw-thread container finish. The flexibility of the flange 32 also eliminates the criticality of precisely centering the adaptor relative to the cap when being handled in the automatic assembly equipment. Further, the flexibility of the flange 32 centers the adaptor relative to the cap so that when it is applied to the container the beveled lower edge of the rib 22 on the adaptor acts as a pilot and is easily guided over the container finish so that when the cap is fully threaded onto the container, the adaptor snaps in place on the axial end face of the container again in the manner shown in FIGS. 2 and 4. Note also that the cap sealing flange 50 and reversely tapered adaptor flange 32 provide a dual seal preventing leakage of fluid from the container so that even if the container is placed on its side there is no leakage. Now when it is desired to dispense the contents, the cap 12 is simply threaded in the reverse direction and the reversely tapered flange 32 is flexed inwardly by the rib 44 to release the cap. Note the seating force of the rib 44 tending to maintain the adaptor assembled is less than the seating force of the rib 14*b* on the container finish and thus the adaptor remains in place when the cap is removed. Likewise when the cap is reapplied, the flange simply is deflected inwardly about the fulcrum or apex 34 and, therefore, does not offer a hindrance or obstacle to assembly or disassembly of the cap.

What is claimed is:

1. A pouring adaptor-closure assembly comprising;

an adaptor adapted to be secured to the discharge end of a container or the like comprising, a generally cylindrical skirt portion having a lower terminal edge which detachably locks under a protruding rib on the container finish after the assembly is secured to the container, a radially inwardly directed top portion which snugly seats on the axial end face of the container, said top portion having a frusto-conical outer face which is outwardly divergent from its inner peripheral edge and a reverseably tapered flexible flange which is downwardly divergent from the juncture of the frusto-conical outer face and flange to provide a non-drip edge as the contents are poured from the container and, a closure cap having a top and a generally cylindrical skirt portion with internal threads adapted to cooperate with threads on the container finish, means defining a rib spaced downwardly form said top defining a sidewall groove on the interior of the cap within which the flexible flange of the adaptor releasably seats and compresses radially inwardly to provide a primary seal for the container contents and to secure said adaptor to said cap prior to use, said closure cap including a circumferentially extending sealing rib projecting from the inside of the top of the cap which engages against the frusto-conical face of the adaptor to provide a secondary seal for the container contents.

2. A pouring adaptor as claimed in claim 1 wherein the frusto-conical outer face is disposed at an angle of about 15° to a plane transverse to the axis of the adaptor.

3. A pouring adaptor as claimed in claim 1 wherein the flexible flange is disposed at an angle of 30° to a plane transverse to the axis of the adaptor.

* * * * *